US009962015B2

(12) United States Patent
Goto et al.

(10) Patent No.: US 9,962,015 B2
(45) Date of Patent: May 8, 2018

(54) SHOWCASE

(71) Applicant: FUJI ELECTRIC CO., LTD., Kawasaki-shi, Kanagawa (JP)

(72) Inventors: Mikio Goto, Kuwana (JP); Noriyuki Take, Yokkaichi (JP)

(73) Assignee: FUJI ELECTRIC CO., LTD., Kawasaki-Shi, Kanagawa (JP)

( * ) Notice: Subject to any disclaimer, the term of this patent is extended or adjusted under 35 U.S.C. 154(b) by 0 days. days.

(21) Appl. No.: 14/924,064

(22) Filed: Oct. 27, 2015

(65) Prior Publication Data

US 2016/0242572 A1 Aug. 25, 2016

(30) Foreign Application Priority Data

Feb. 23, 2015 (JP) ..... 2015-033324

(51) Int. Cl.

| | |
|---|---|
| ***A47F 3/00*** | (2006.01) |
| ***A47F 3/06*** | (2006.01) |
| ***A47B 57/40*** | (2006.01) |
| ***A47B 57/42*** | (2006.01) |
| *A47F 3/04* | (2006.01) |

(52) U.S. Cl.

CPC ..... *A47F 3/06* (2013.01); *A47B 57/402* (2013.01); *A47B 57/42* (2013.01); *A47F 3/005* (2013.01); *A47F 3/043* (2013.01); *A47F 3/0408* (2013.01)

(58) Field of Classification Search

CPC ..... A47F 3/005; A47B 57/42; A47B 57/50; A47B 57/52

USPC ..... 108/108; 211/192; 312/114, 126, 128, 312/132, 408

See application file for complete search history.

(56) References Cited

U.S. PATENT DOCUMENTS

| | | | | |
|---|---|---|---|---|
| 2,661,993 A * | 12/1953 | Little | A47B 87/00 211/134 |
| 3,565,264 A * | 2/1971 | Guiher | A47B 57/402 211/117 |
| 4,467,729 A * | 8/1984 | Featherman | A47B 57/16 108/107 |
| 5,377,851 A * | 1/1995 | Asano | A47B 47/022 211/191 |
| 6,416,145 B1 * | 7/2002 | Singh | A47B 88/427 312/333 |
| 6,948,691 B2 * | 9/2005 | Brock | A47B 88/044 211/175 |

(Continued)

FOREIGN PATENT DOCUMENTS

JP 2008-167927 A 7/2008

*Primary Examiner* — Matthew W Ing

(74) *Attorney, Agent, or Firm* — Manabu Kanesaka

(57) ABSTRACT

A showcase includes: a case main body; and article mounting shelves that mount articles as objects to be stored. The showcase causes the articles to be visually recognized through a customer serving face. Each of the article mounting shelves includes: a pair of brackets supported by a pair of shelf columns; and a shelf board. Each of the brackets includes locking pieces that are provided with respective notches at lower ends of predetermined areas. The showcase is supported by each of the shelf columns by causing the locking pieces to be inserted into corresponding inner face locking holes formed on an inner face of each of the shelf columns and causing lower edges of the inner face locking holes to relatively enter the notches, to cause the locking pieces to be locked to the inner face locking holes.

11 Claims, 18 Drawing Sheets

(56) References Cited

U.S. PATENT DOCUMENTS

| | | | | |
|---|---|---|---|---|
| 2003/0117050 | A1* | 6/2003 | Hamilton | F25D 25/024 312/408 |
| 2008/0012459 | A1* | 1/2008 | Picken | F24C 15/16 312/408 |
| 2008/0169735 | A1 | 7/2008 | Yamazaki et al. | |
| 2012/0145663 | A1* | 6/2012 | Dykstra | A47B 46/00 211/187 |
| 2014/0055017 | A1* | 2/2014 | McMillin | A47B 96/027 312/237 |

* cited by examiner

SHOWCASE

CROSS-REFERENCE TO RELATED APPLICATIONS

The present application claims priority to and incorporates by reference the entire contents of Japanese Patent Application No. 2015-033324 filed in Japan on Feb. 23, 2015.

BACKGROUND OF THE INVENTION

1. Field of the Invention

The present invention relates to a showcase.

2. Description of the Related Art

Japanese Laid-open Patent Publication No. 2008-167927 discloses a showcase that is installed on a counter of a store such as a convenience store and mounts articles so as to be visually recognizable from the outside.

Such a showcase includes a case main body. The case main body is formed in a box shape and forms a storage room therein. In the case main body, a front face constituting the storage room constitutes a customer serving face, and an opening is formed in a rear face constituting the storage room.

Article mounting shelves are arranged in a plurality of stages in the up-and-down direction in the storage room of the case main body. The article mounting shelves mount articles to be stored. The opening formed in the rear face of the case main body is opened and closed through right and left sliding movement of a plurality of glass doors.

In such a showcase, the front face (the customer serving face) or the like constituting the storage room in the case main body is formed of a transparent resin material or the like, thereby causing the articles mounted on the article mounting shelves to be visually recognized through the customer serving face.

In the showcase disclosed in Japanese Laid-open Patent Publication No. 2008-167927, the glass doors are moved to open and the opening on the rear face of the case main body is opened, and then, inside the case main body, the article mounting shelves are replenished with articles, or the articles are taken out of the article mounting shelves.

However, performing work to take out the articles or the like inside the case main body requires salesclerks of stores to insert their fingers or the like inside the case main body, which makes the work troublesome.

SUMMARY OF THE INVENTION

It is an object of the present invention to at least partially solve the problems in the conventional technology.

According to one aspect of the present invention, there is provided a showcase including: a case main body including: a front face constituting a customer serving face; and a rear face having an opening that is opened and closed by a door; and article mounting shelves that are arranged in a plurality of stages in an up-and-down direction in a storage area provided within the case main body and mount articles as objects to be stored, wherein the showcase causes the articles mounted on the article mounting shelves to be visually recognized through the customer serving face, each of the article mounting shelves includes: a pair of right and left brackets supported by a pair of right and left shelf columns that are erected so that inner faces thereof face each other at a rear side of the storage area; and a shelf board an upper face of which constitutes an article mounting face that mounts the articles and that is slidingly movable rearward in between the brackets when being operated to be drawn rearward, each of the brackets includes a plurality of locking pieces that are formed by bending respective parts of a rear end thereof in a direction opposite to the other bracket and are provided with respective notches at lower ends of predetermined areas including the bent parts, and the showcase is supported by each of the shelf columns by causing the locking pieces to be inserted into corresponding inner face locking holes formed on an inner face of each of the shelf columns and causing lower edges of the inner face locking holes to relatively enter the notches, to cause the locking pieces to be locked to the inner face locking holes.

According to another aspect of the present invention, there is provided a showcase including: a case main body including: a front face constituting a customer serving face; and a rear face having an opening that is opened and closed by a door; and article mounting shelves that are arranged in a plurality of stages in an up-and-down direction in a storage area provided within the case main body and mount articles as objects to be stored, wherein the showcase causes the articles mounted on the article mounting shelves to be visually recognized through the customer serving face, each of the article mounting shelves includes: a pair of right and left brackets supported by a pair of right and left shelf columns that are erected so that inner faces thereof face each other at a rear side of the storage area; and a shelf board an upper face of which constitutes an article mounting face that mounts the articles and that is slidingly movable rearward in between the brackets when being operated to be drawn rearward, and the showcase includes a limiting unit that is interposed between each of the brackets and one side face close to each of the brackets out of a pair of right and left side faces of the case main body and prevents each of the brackets from approaching the one side face.

According to still another aspect of the present invention, there is provided a showcase including: a case main body including: a front face constituting a customer serving face; and a rear face having an opening that is opened and closed by a door; and article mounting shelves that are arranged in a plurality of stages in an up-and-down direction in a storage area provided within the case main body and mount articles as objects to be stored, wherein the showcase causes the articles mounted on the article mounting shelves to be visually recognized through the customer serving face, each of the article mounting shelves includes: a pair of right and left brackets supported by a pair of right and left shelf columns that are erected so that inner faces thereof face each other at a rear side of the storage area; and a shelf board an upper face of which constitutes an article mounting face that mounts the articles and that is slidingly movable rearward in between the brackets when being operated to be drawn rearward, each of the brackets includes a contact piece that is formed by cutting and raising a part of a rear end thereof in a direction opposite to the other bracket and includes a locking protrusion protruding rearward on at least either one of an upper end and a lower end, and the showcase is supported by each of the shelf columns with the locking protrusion inserted into a front face locking hole formed on a front face of each of the shelf columns and with a rear face of the contact piece being in contact with the front face of each of the shelf columns.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

The following describes a preferred embodiment of a showcase according to the present invention in detail with reference to the attached drawings.

Figure 1:
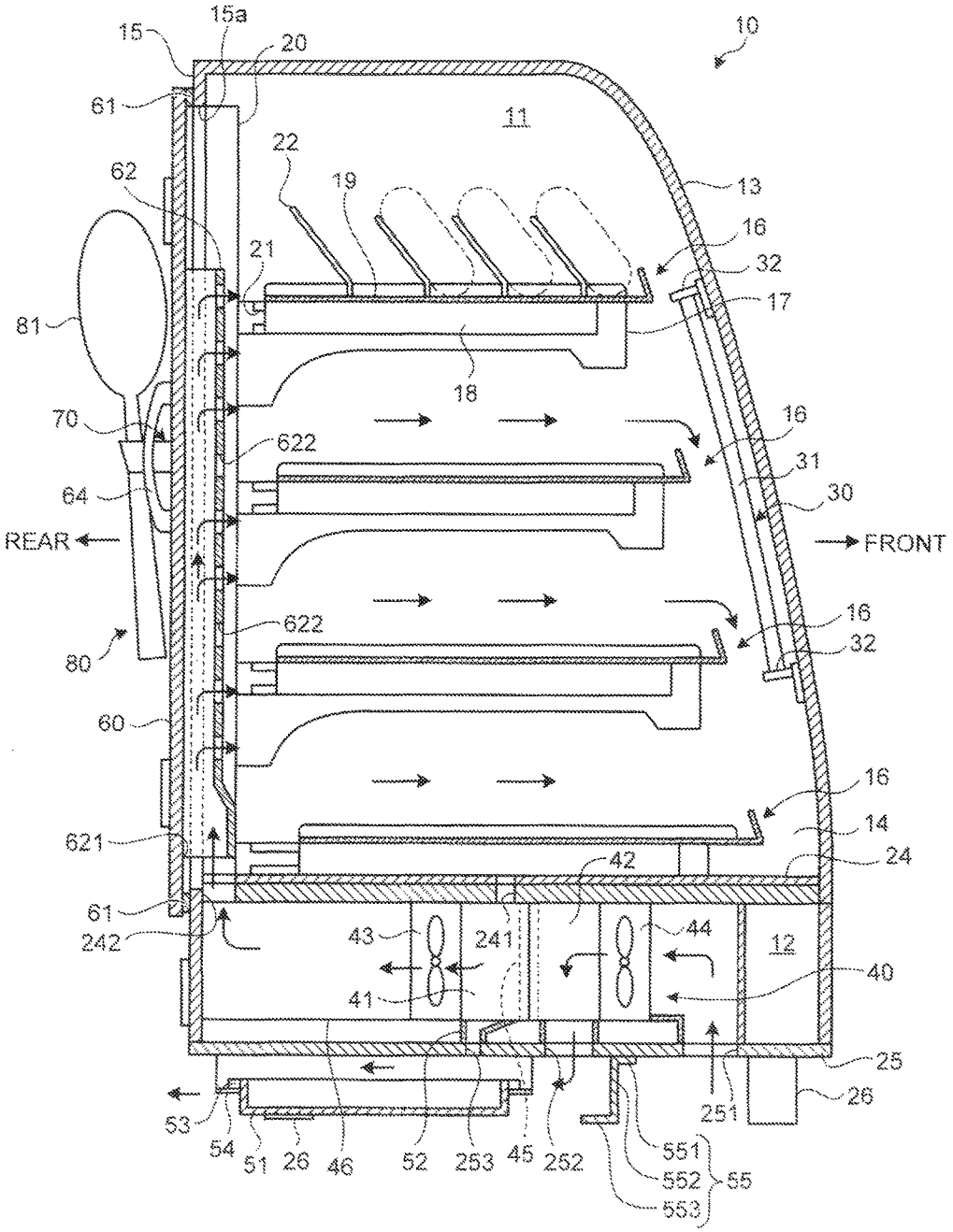
FIG. 1 is a sectional side view schematically illustrating an internal structure of a showcase as an embodiment of the present invention when viewed from the left side.

FIG. 1 is a sectional side view schematically illustrating an internal structure of a showcase as an embodiment of the present invention when viewed from the left side. The showcase exemplified in this example is installed on a counter of a store such as a convenience store to show articles such as donuts, for example, and includes a case main body 10 and a door 60.

The case main body 10 is formed in a box shape and the inside thereof is sectioned into a storage room 11 and a machine room 12 in the up-and-down direction. In the case main body 10, a front face 13 constituting the storage room 11 constitutes a customer serving face together with right and left both side faces 14, and an opening (hereinafter, also referred to as a rear face opening) 15*a* is formed in a rear face 15 constituting the storage room 11. In the case main body 10, all faces constituting the storage room 11 are formed of a transparent glass material or resin material having a heat insulating structure, thereby enabling the storage room 11 to be visually recognized from the outside. The front face 13 constituting the customer serving face is gradually curved rearward in the upward direction.

In the storage room 11 of the case main body 10, a plurality of article mounting shelves 16 are arranged in a plurality of stages in the up-and-down direction.

Figure 2:
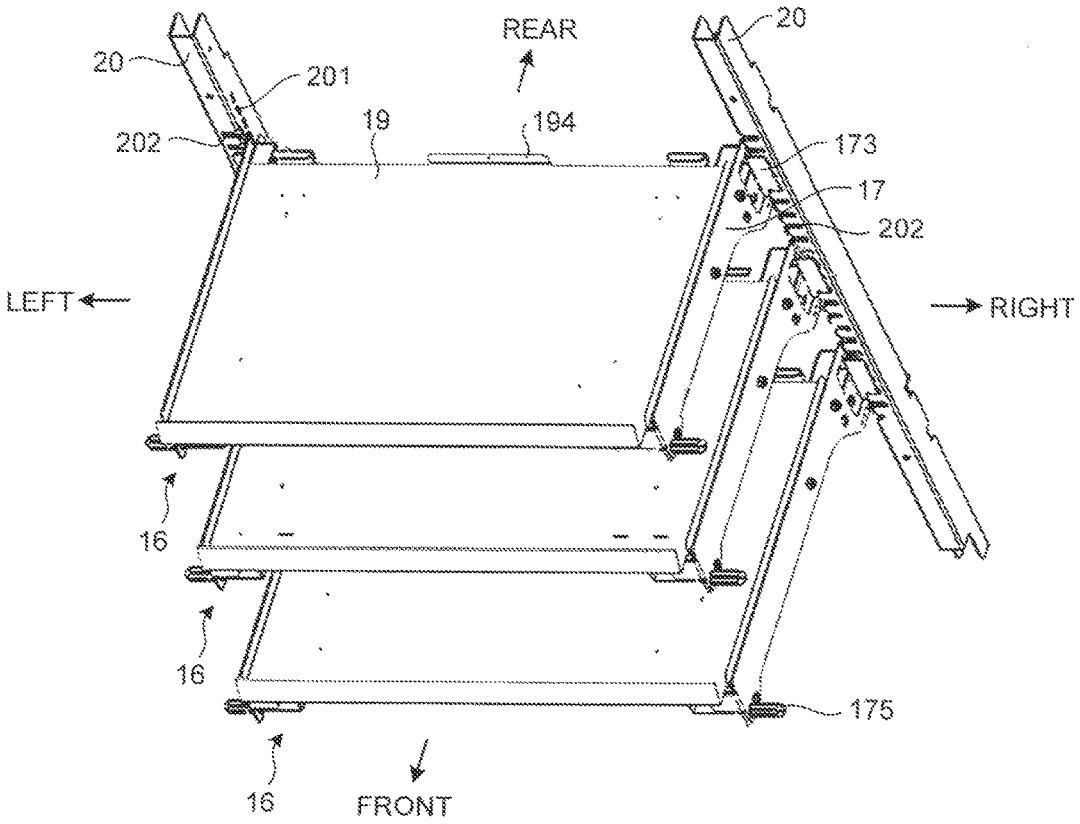
FIG. 2 is a perspective view illustrating a plurality of article mounting shelves in a storage room when viewed from the upper right side.
Figure 3:
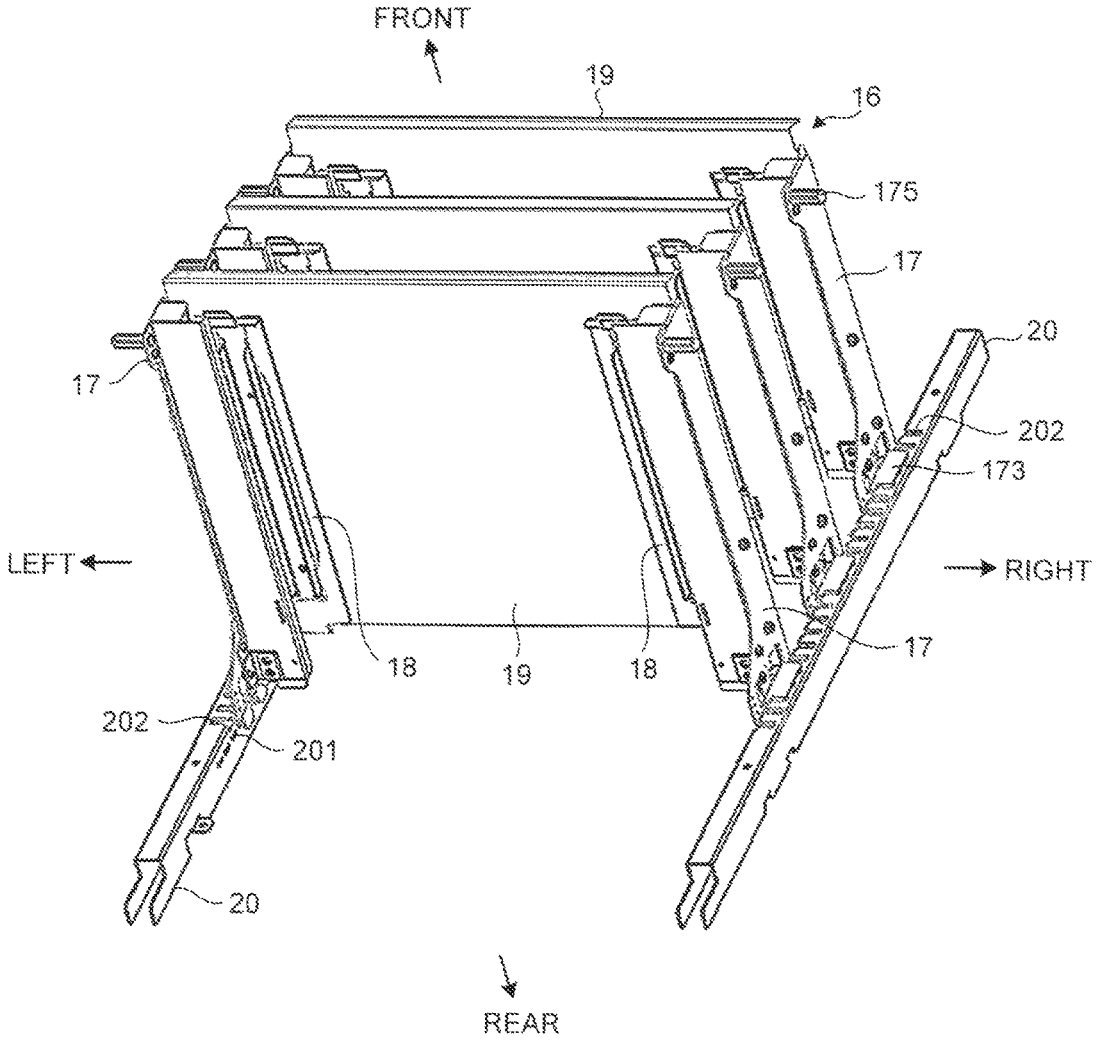
FIG. 3 is a perspective view illustrating the article mounting shelves in the storage room when viewed from the lower right side.

FIG. 2 and FIG. 3 illustrate the article mounting shelves 16 in the storage room 11: FIG. 2 is a perspective view when viewed from the upper right side, whereas FIG. 3 is a perspective view when viewed from the lower right side. As illustrated in FIG. 2 and FIG. 3, the article mounting shelf 16 includes brackets 17, receiving members 18, and a shelf board 19.

Figure 4:
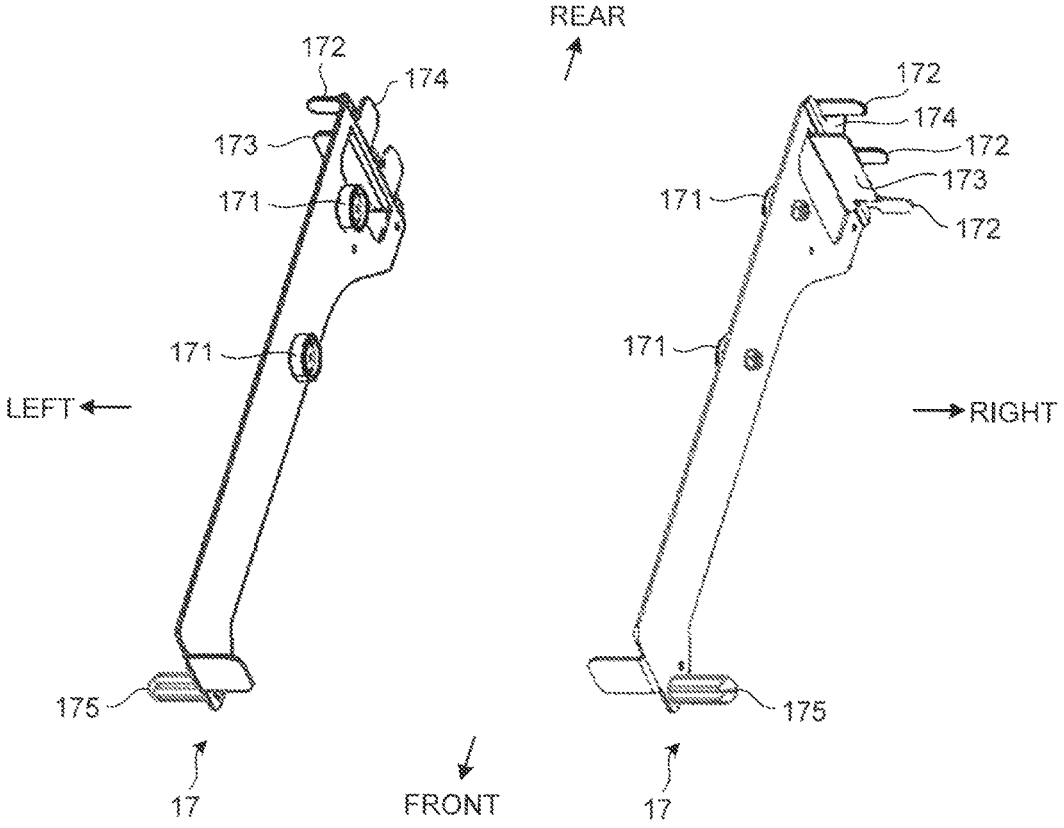
FIG. 4 is a perspective view illustrating brackets.

As illustrated in FIG. 4, the brackets 17 are a pair of right and left members. The brackets 17 are supported by shelf columns 20 so that inner faces thereof face each other. The "inner faces" in this example refer to the left face for the right bracket 17 and the right face for the left bracket 17. The left bracket 17 is different from the right bracket 17 only in the structure in the right-and-left direction, and the following describes the right bracket 17, with a description of the left bracket 17 omitted.

The shelf columns 20 are a pair of right and left members that are erected so that the inner faces thereof face each other at the rear side of the storage room 11. The shelf columns 20 are provided with first locking holes (inner face locking holes) 201 and second locking holes (front face locking holes) 202. The "inner faces" in this example refer to the left face for the right shelf column 20 and the right face for the left shelf column 20.

The first locking holes 201 are rectangular holes formed at certain intervals in the up-and-down direction on the inner faces of the respective shelf columns 20. In other words, the first locking holes 201 formed at different height levels on the inner faces of the respective shelf columns 20 are formed so as to face each other in a right-and-left paired manner.

The second locking holes 202 are formed at certain intervals in the up-and-down direction on the front faces 13 of the respective shelf columns 20. The second locking holes 202 are oblong holes formed in a continuous manner on the inner faces of the respective shelf columns 20. The second locking hole 202 is formed so that the up-and-down dimension of a part opening in the inner face of the shelf column 20 is larger than the up-and-down dimension of a part opening in a front face of the shelf column 20.

Figure 5:
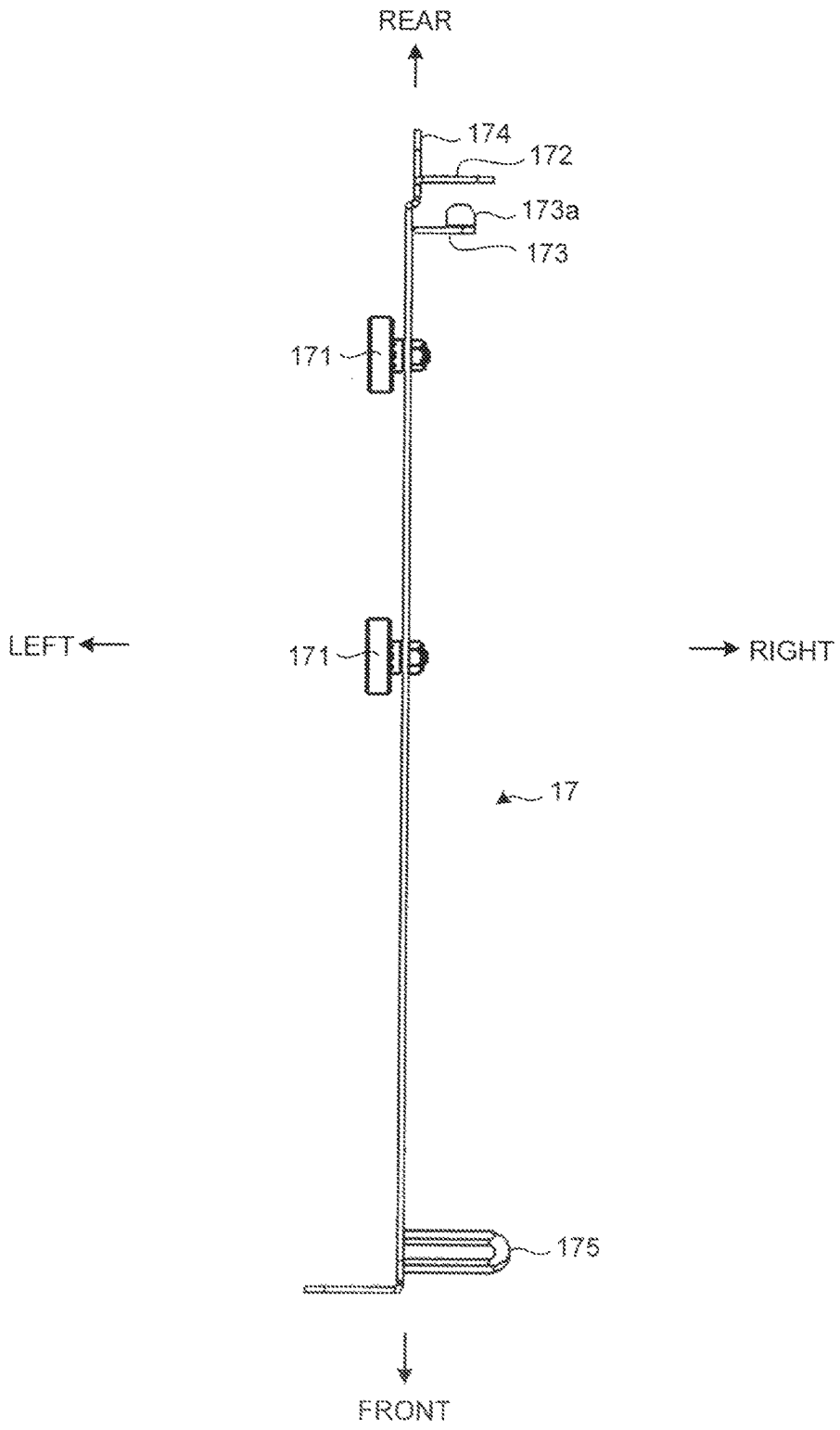
FIG. 5 is a plan view of a right bracket.
Figure 6:
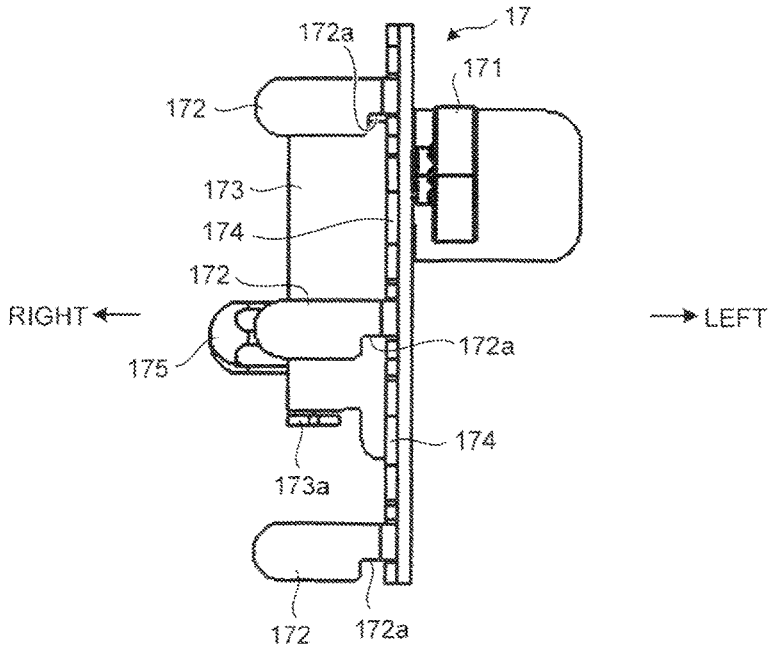
FIG. 6 is a rear view of the right bracket.

FIG. 5 and FIG. 6 illustrate the right bracket 17: FIG. 5 is a plan view of the right bracket 17, whereas FIG. 6 is a rear view of the right bracket 17. As illustrated in FIG. 5 and FIG. 6, the bracket 17 has two bracket rollers 171 arranged on the inner face thereof in a rotatable manner and is provided with locking pieces 172, a contact piece 173, engaging pieces 174, and a side stopper 175.

A plurality of (three in the illustrated example) locking pieces 172 are formed by separately bending a tongue-shaped part at the rear end of the bracket 17 in a direction opposite to the other bracket 17, that is, rightward.

The lower ends of the basal ends of the respective locking pieces 172 are provided with respective notches 172*a*. The length of the notch 172*a* in the right-and-left direction is slightly larger than the thickness of sheet metal constituting the shelf column 20, that is, the thickness of the opening edge of the first locking hole 201.

The contact piece 173 is formed by bending a rectangular part formed by cutting and raising a part at the rear end of the bracket 17 and at the front side than the locking pieces 172 in the same direction as the locking pieces 172. The contact piece 173 is a long part with the up-and-down direction as the longitudinal direction thereof. A locking protrusion 173*a* is arranged at a lower end of the contact piece 173. The locking protrusion 173*a* is formed by bending a lower end edge of the contact piece 173 rearward and protrudes rearward.

A plurality of (two in the illustrated example) engaging pieces 174 are plate-shaped parts separately formed so as to protrude rearward at the rear end of the bracket 17 in between the locking pieces 172. The side stopper 175 is a rod-shaped member arranged so as to protrude rightward at the front end of the bracket 17. The side stopper 175 is a long member with the right-and-left direction as the longitudinal direction thereof, and the length thereof in the right-and-left direction is a size that enables the tip thereof to be in contact with the side face 14 (the right side face 14) of the case main body 10.

Figure 7:
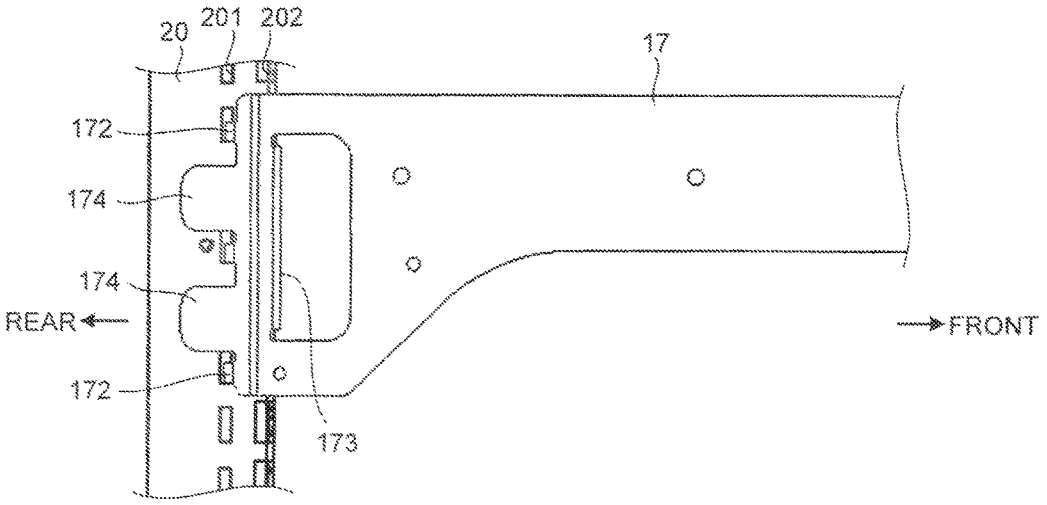
FIG. 7 is a left side view illustrating a state in which the right bracket is supported by a right shelf column.
Figure 8:
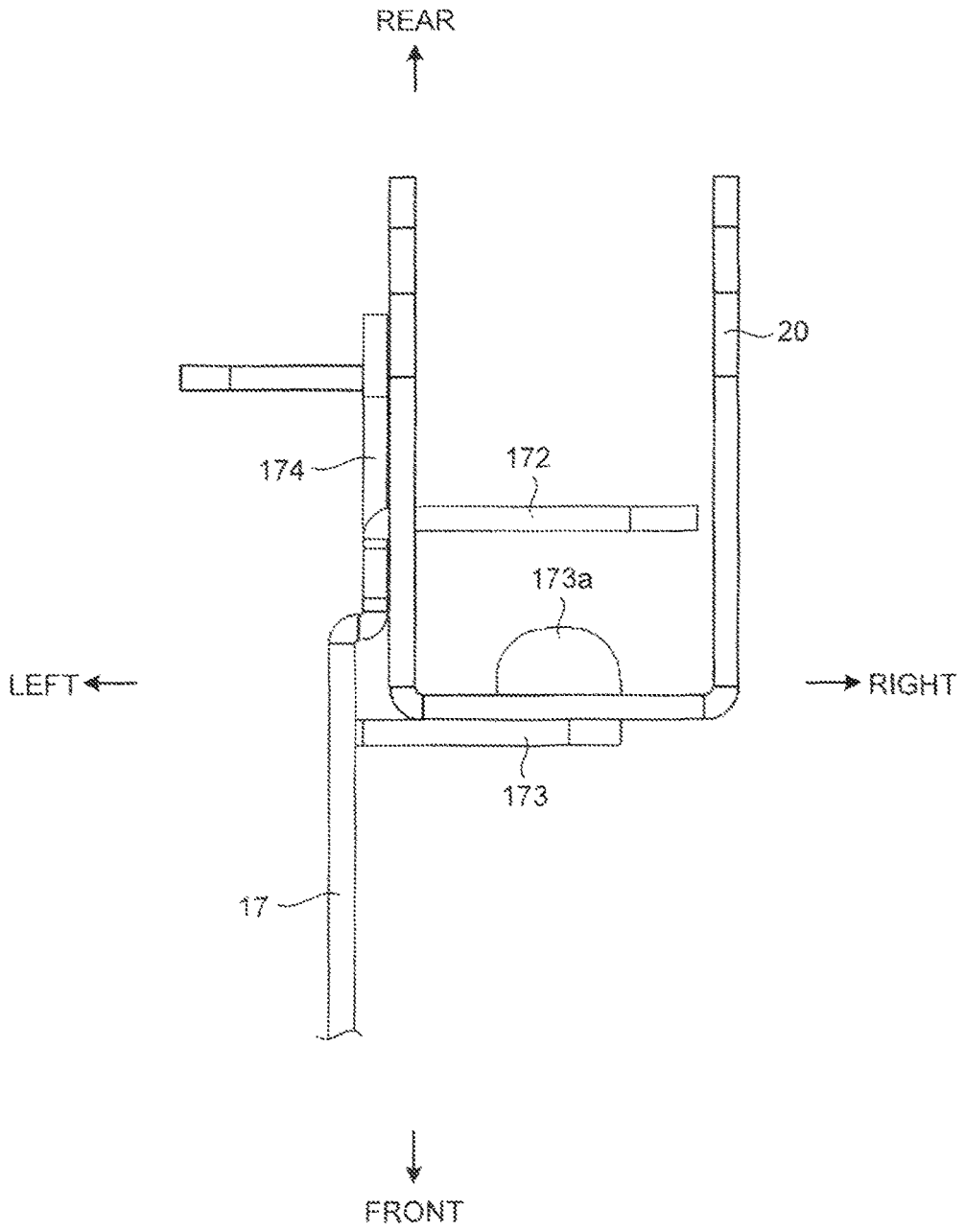
FIG. 8 is a plan view illustrating a state in which the right bracket is supported by the right shelf column.

FIG. 7 and FIG. 8 illustrate a state in which the right bracket 17 is supported by the right shelf column 20: FIG. 7 is a left side view, whereas FIG. 8 is a plan view.

Figure 9:
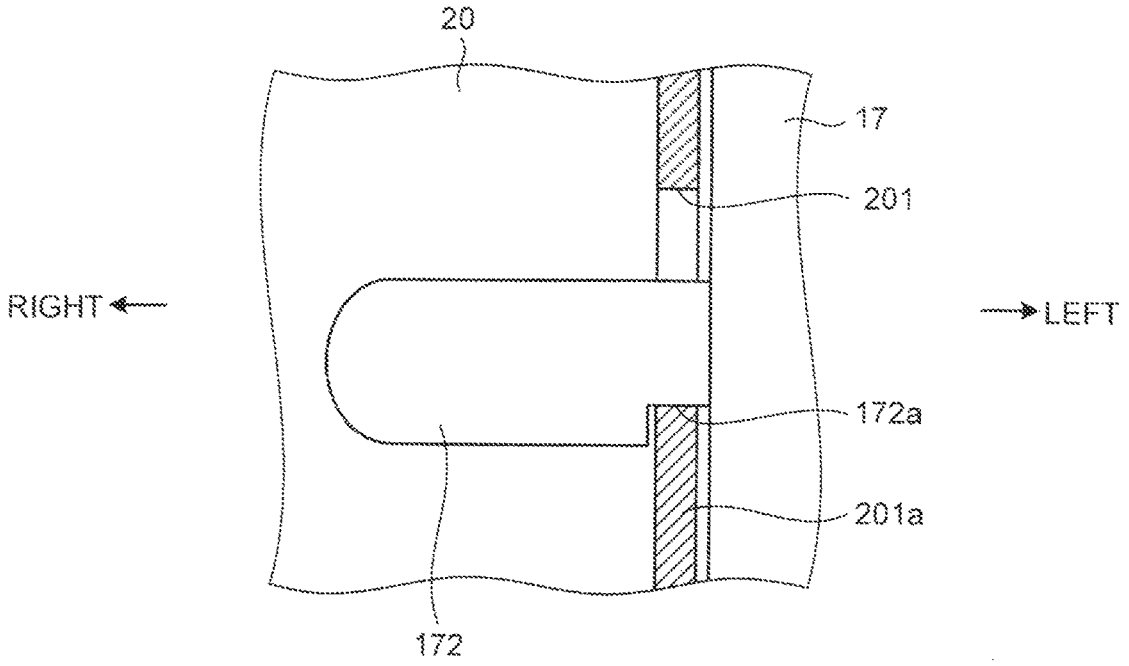
FIG. 9 is a schematic diagram illustrating a state in which a locking piece is inserted into a first locking hole to be locked.

The right bracket 17 is brought close to the right shelf column 20 from the left side, the locking pieces 172 are made to enter the first locking holes 201, and the locking protrusion 173*a* is made to enter the second locking hole 202. Subsequently, as illustrated in FIG. 9, the right bracket 17 is displaced downward so that a lower edge 201*a* of the first locking hole 201 relatively enters the notch 172*a* of the locking piece 172, thereby bringing the contact piece 173 into contact with the front face of the shelf column 20 and bringing the engaging pieces 174 into contact with the inner face of the shelf column 20, and thus the right bracket 17 is supported by the right shelf column 20.

Figure 10:
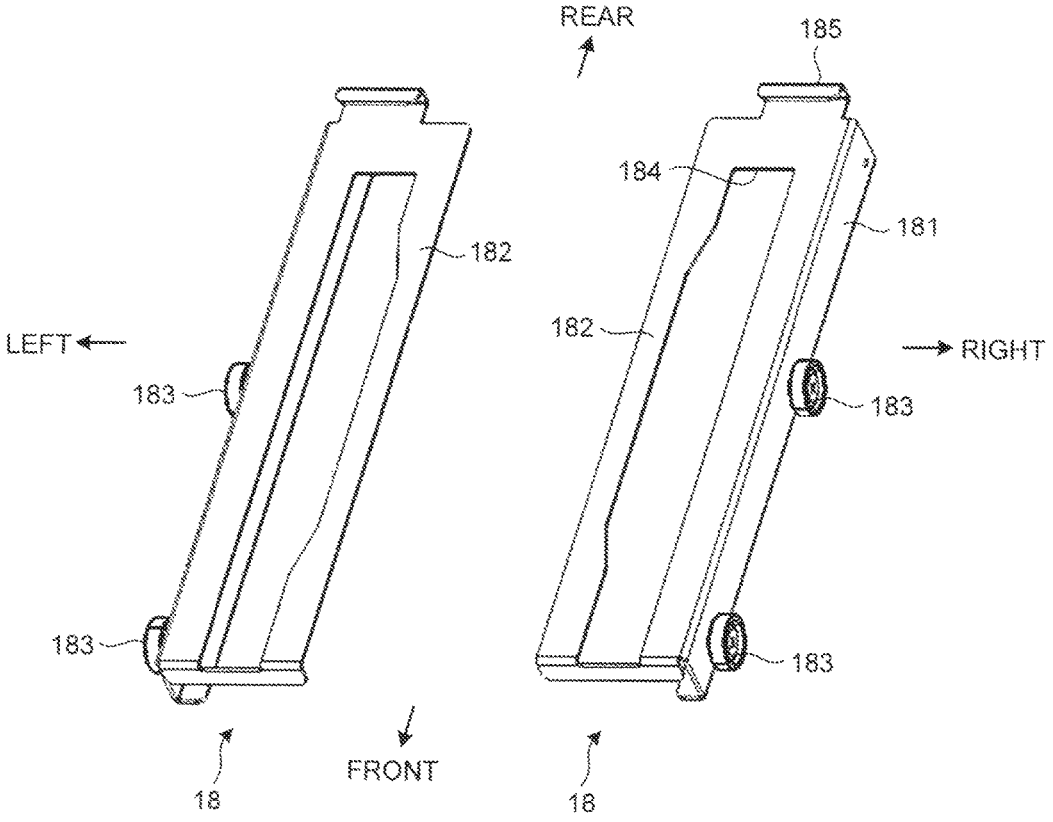
FIG. 10 is a perspective view illustrating receiving members.

As illustrated in FIG. 10, the receiving members 18 are a pair of right and left members. The left receiving member 18 is different from the right receiving member 18 only in the structure in the right-and-left direction, and the following describes the right receiving member 18, with a description of the left receiving member 18 omitted.

The receiving member 18 is a long member with the front-and-rear direction as the longitudinal direction thereof and includes a receiving base 181 extending in the front-and-rear direction and a receiving upper face 182 extending leftward from an upper end edge of the receiving base 181. Two receiving unit rollers 183 are arranged on the right face of the receiving base 181 in a rotatable manner. The receiving upper face 182 is provided with a receiving oblong hole 184 with the front-and-rear direction as the longitudinal direction thereof. The receiving oblong hole 184 is formed so that the width of the central part in the longitudinal direction is larger than the widths of the front part and the rear part. The rear end of the receiving upper face 182 is provided with a reception stopper 185. The reception stopper 185 is formed by bending a rectangular part protruding rearward at the rear end of the receiving upper face 182 upward and then bending the rectangular part frontward.

Figure 11:
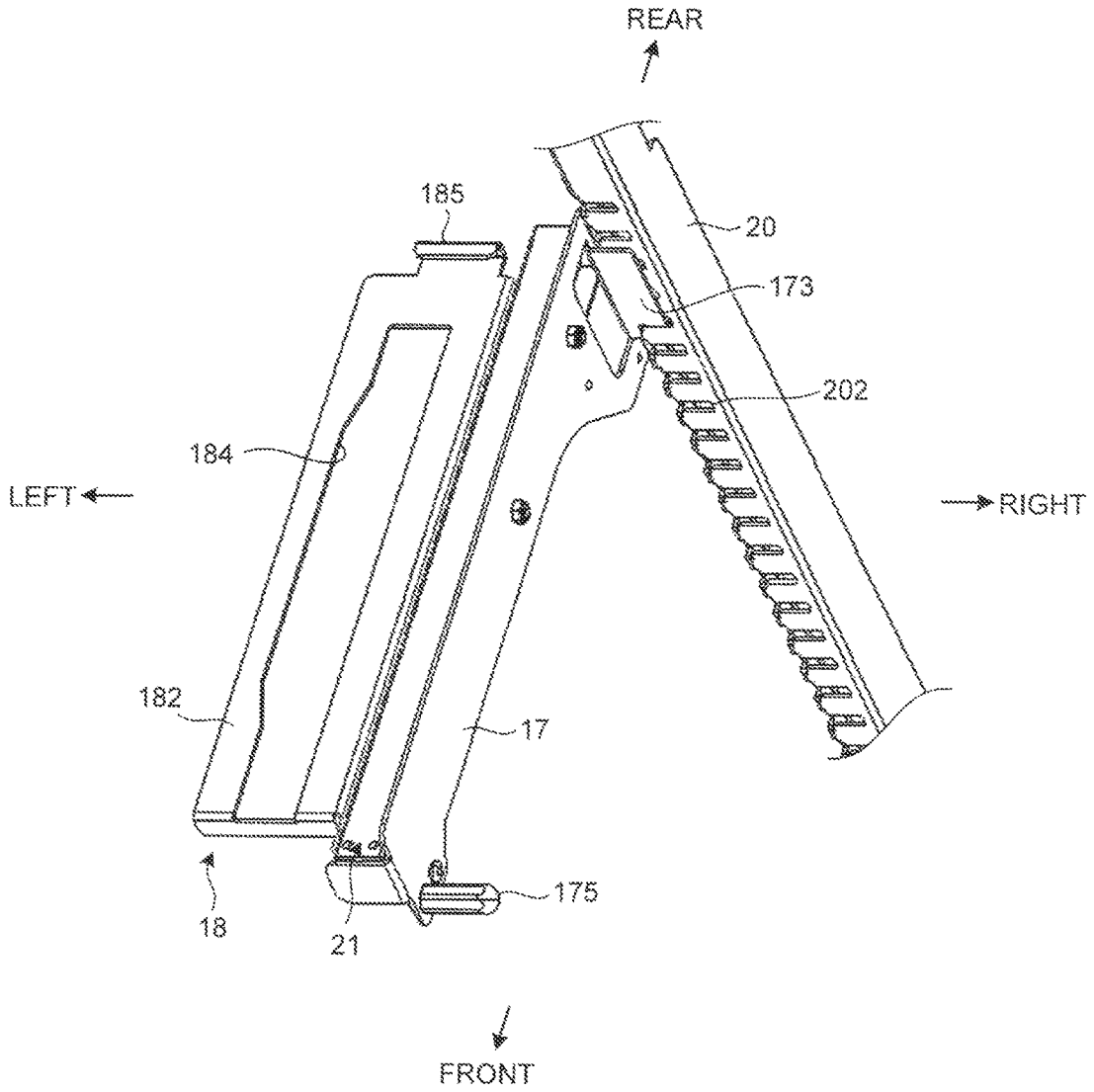
FIG. 11 is a perspective view illustrating the principal part of an article mounting shelf.
Figure 12:
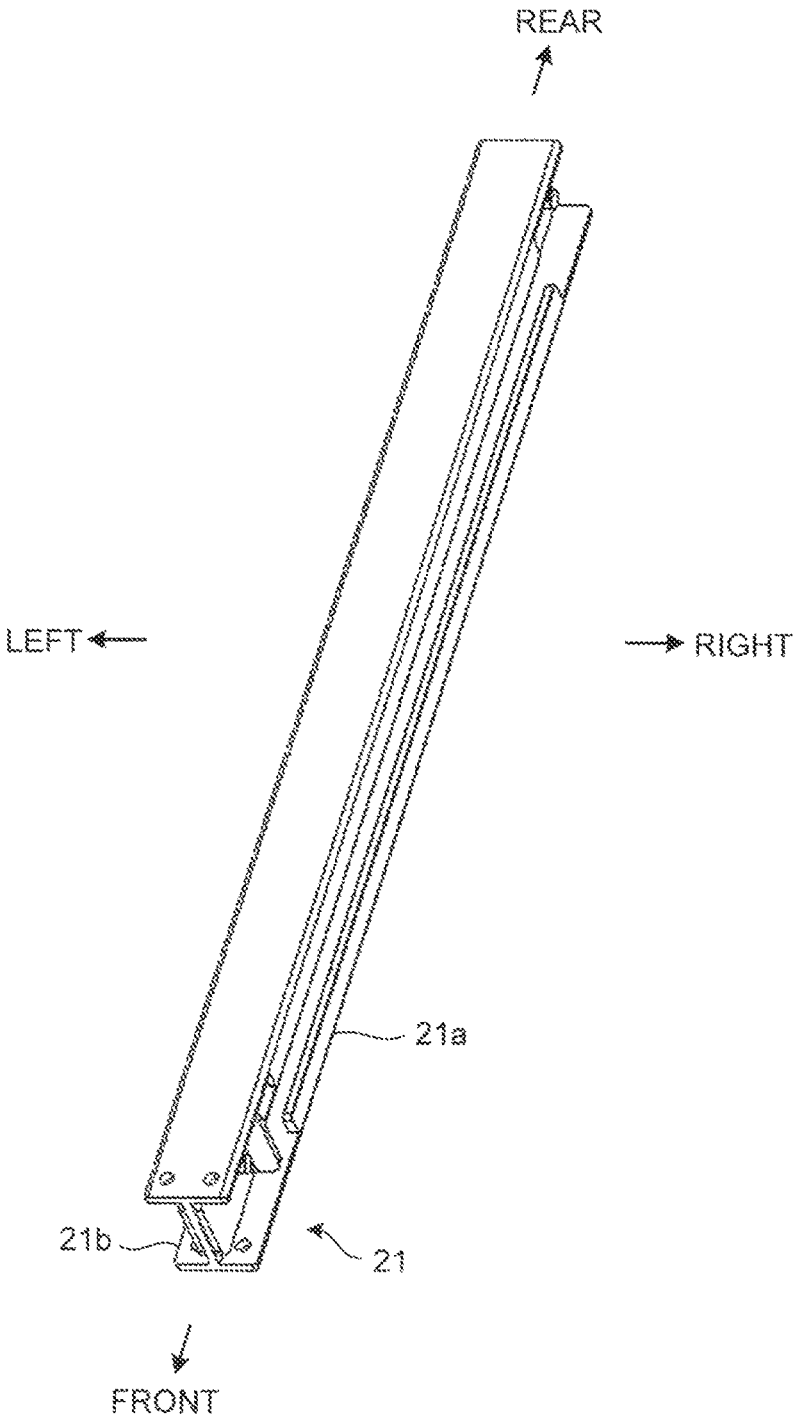
FIG. 12 is a perspective view illustrating a rail.

As illustrated in FIG. 11, the receiving member 18 is arranged on the inner face of the bracket 17 via a rail 21. As illustrated in FIG. 12, the rail 21 is constituted by jointing a bracket rail 21*a* and a shelf rail 21*b* together. The rails 21 are also a pair of right and left members similarly to the brackets 17 and the receiving members 18. The left rail is different from the right rail 21 only in the structure in the right-and-left direction, and the following describes the right rail 21, with a description of the left rail omitted.

The bracket rail 21*a* is a long, rod-shaped member the longitudinal section of which is formed in a nearly U shape with the front-and-rear direction as the longitudinal direction thereof. The bracket rail 21*a* allows an entry of the bracket rollers 171 and rolls the bracket rollers 171. The shelf rail 21*b* is a long, rod-shaped member the longitudinal section of which is formed in a nearly U shape with the front-and-rear direction as the longitudinal direction thereof. The shelf rail 21*b* allows an entry of the receiving unit rollers 183 and rolls the receiving unit rollers 183.

The bracket rollers 171 thus enter the bracket rail 21*a* and roll, thereby enabling the rail 21 to slidingly move in the front-and-rear direction with respect to the bracket 17. The receiving unit rollers 183 enter the shelf rail 21*b* of the rail 21 and roll, thereby enabling the receiving member 18 to slidingly move in the front-and-rear direction with respect to the rail 21. In other words, the receiving member 18 is arranged so as to be moveable in the front-and-rear direction with respect to the inner face of the bracket 17 via the rail 21.

Figure 13:
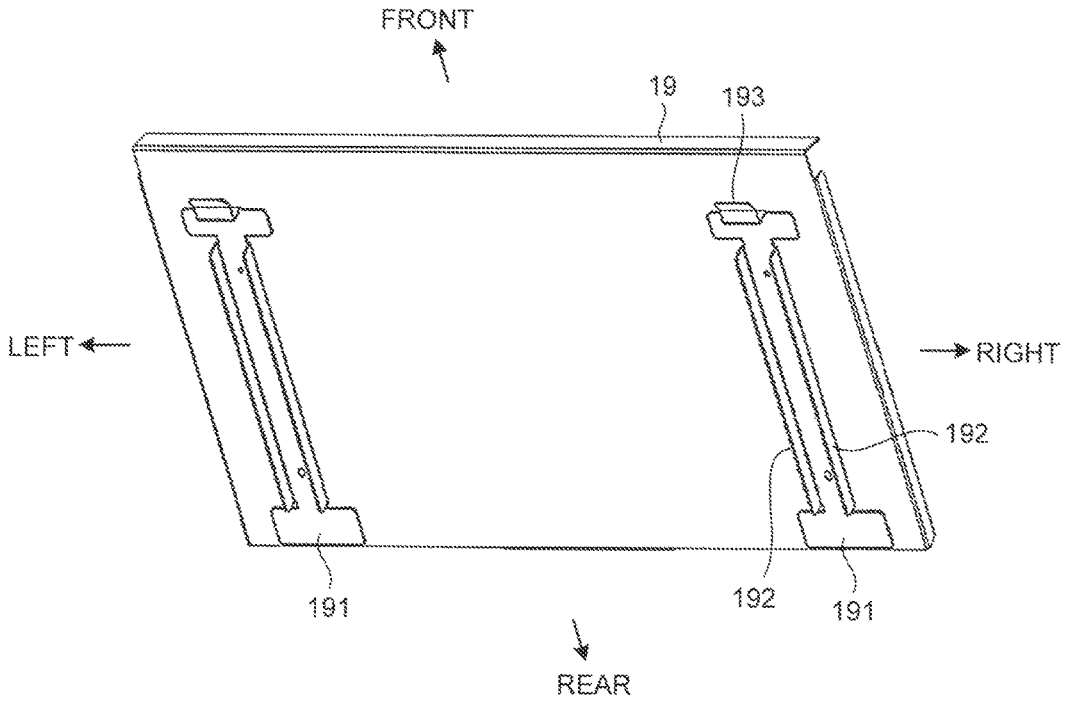
FIG. 13 is a perspective view illustrating a shelf board.

The shelf board 19 is formed in a plate shape the upper face of which constitutes an article mounting face for mounting articles. As illustrated in FIG. 13, engaging members 191 are arranged at right and left both ends on the lower face of the shelf board 19. The engaging member 191 includes long protrusions 192 with the front-and-rear direction as the longitudinal direction thereof protruding downward. The lengths of the long protrusions 192 in the front-and-rear and right-and-left directions are sizes that enable an entry to the receiving oblong hole 184. The engaging member 191 has a hook 193 arranged at the front end of the long protrusions 192.

The shelf board 19 is engaged with the receiving members 18 so as to be astride the receiving members 18 by causing the long protrusions 192 of the respective engaging members 191 to enter the receiving oblong holes 184 of the respective receiving members 18, causing the hooks 193 to be engaged with the front edges of the receiving oblong holes 184 of the respective receiving members 18, and limiting backward movement by the reception stoppers 185 as illustrated in FIG. 2 and FIG. 3.

The shelf board 19 is provided with a shelf handle 194 (refer to FIG. 2). The shelf handle 194 is formed so as to extend upward at the central part in the right-and-left direction at the rear end of the shelf board 19.

The shelf board 19 can slidingly move in the front-and-rear direction with respect to the bracket 17 by being engaged with the receiving members 18. In other words, the shelf board 19 can slidingly move rearward through the rear face opening 15*a* when being operated to be drawn and can slidingly move frontward through the rear face opening 15*a* when being operated to be pushed. The upper face of the shelf board 19 mounts articles such as donuts so as to be arranged in the front-and-rear direction and the right-and-left direction in the state of being supported by article guides 22.

Figure 14:
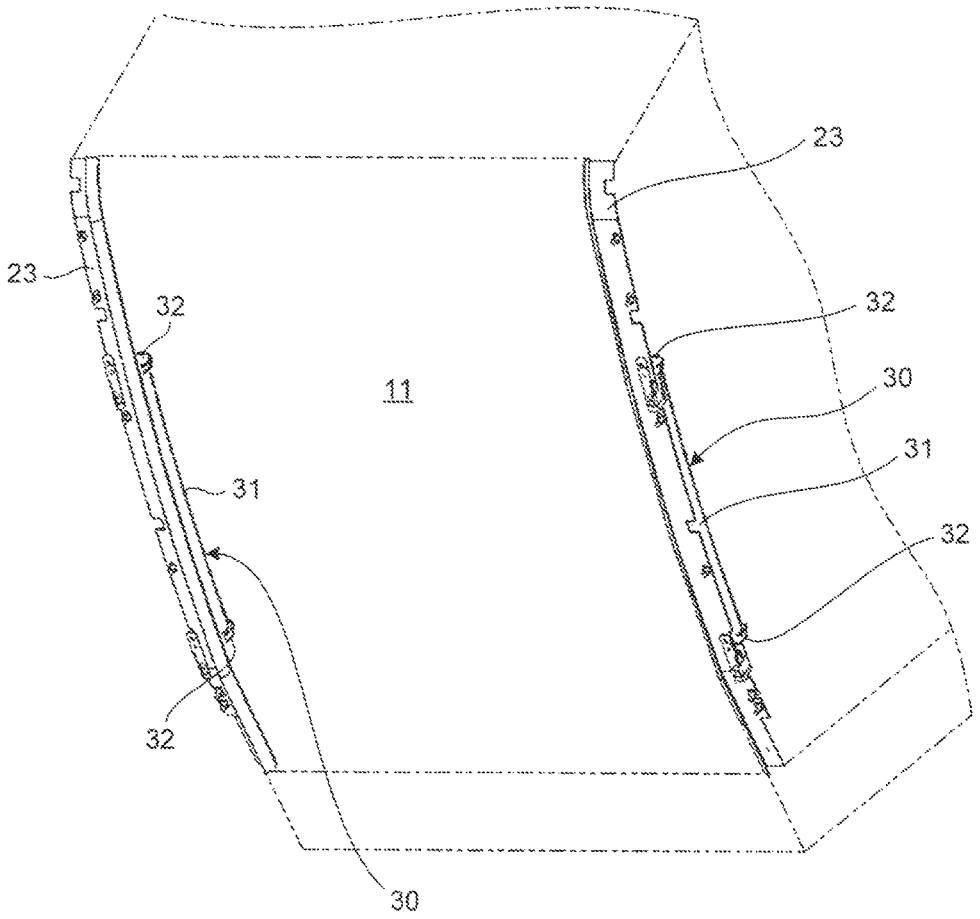
FIG. 14 is a perspective view schematically illustrating the principal part of the showcase.

The storage room 11 includes illuminating members 30. As illustrated in FIG. 14, the illuminating members 30 are a pair of right and left members and are arranged at right and left both sides at the front side of the storage room 11. More specifically, the illuminating members 30 are arranged by being supported by frames 23 curving along the front face 13 of the case main body 10 at right and left both sides at the front side of the storage room 11.

Figure 15:
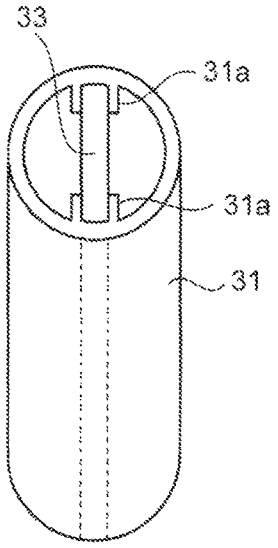
FIG. 15 is a schematic diagram schematically illustrating an LED cover.

The illuminating member 30 includes an LED cover 31. The LED cover 31 is formed of a translucent resin material. The LED cover 31 is formed in a cylindrical shape and curves with a curvature nearly equal to that of the front face 13 of the case main body 10. Both ends of the LED cover 31 are blocked with respective caps 32, and the caps 32 are supported by the respective frames 23. As illustrated in FIG. 15, a pair of support pieces 31*a* extend in the extension direction of the LED cover 31 so as to face each other on the inner face of LED cover 31, and an LED substrate 33 is supported so as to be held between the support pieces 31*a*. In other words, the LED cover 31 stores therein the LED substrate 33.

Figure 16:
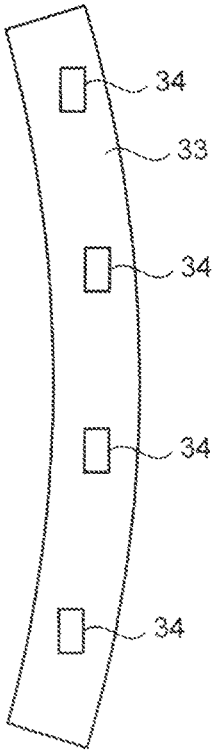
FIG. 16 is a schematic diagram schematically illustrating an LED board.

The LED substrate 33 is a long member and curves in the longitudinal direction as illustrated in FIG. 16. The LED substrate 33 is only required to be stored within the LED cover 31 and is not necessarily required to have a curvature similar to that of the LED cover 31. A plurality of (four in the illustrated example) LEDs 34 are mounted on one face of the LED substrate 33 in the longitudinal direction of the LED substrate 33.

Figure 17:
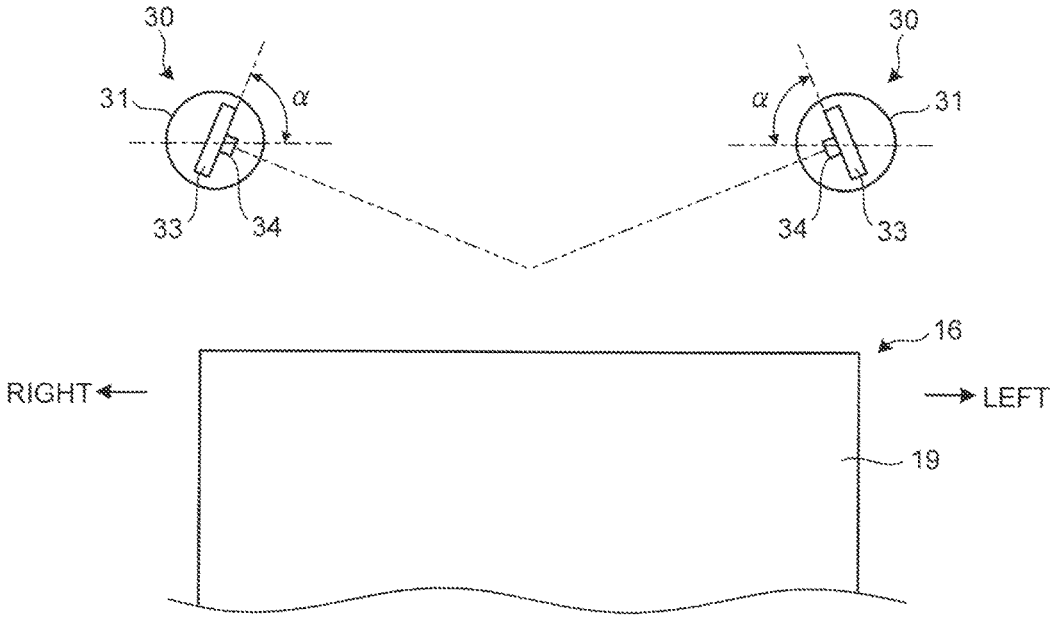
FIG. 17 is a schematic diagram schematically illustrating an arrangement example of an illuminating member.

As illustrated in FIG. 17, in the illuminating members 30 having the above configuration, an arrangement angle $\alpha$ of the LED substrate 33 stored within the LED cover 31 is adjusted so that light emitted from the mounted LED 34 is applied to the central part at the front end of the corresponding article mounting shelf 16. The arrangement angle $\alpha$ is set to 45° to 70°, for example.

A cooling unit 40 is arranged in the machine room 12 of the case main body 10. The cooling unit 40 includes a cooler 41, a radiator 42, a circulating fan 43, and a radiator fan 44.

The cooler 41 is arranged below an air inlet 241 formed in a heat insulating bottom plate 24 that sections the storage room 11 and the machine room 12, and is thermally connected to a low-temperature part of a Peltier element 45. The Peltier element 45 is a known element, in which p-type semiconductors and n-type semiconductors are alternately connected in series with electrode plates, and insulating plates are arranged on the front and back of the semiconductors. By giving a DC current to the electrode plates of the Peltier element 45, one insulating plate absorbs heat (to be a low-temperature part), whereas the other insulting plate generates heat (to be a high-temperature part).

The cooler 41 is formed of a material with excellent heat conductivity and includes a plurality of fins, although not explicitly illustrated in the drawing, and spaces between the fins constitute an air passage for passing air. The cooler 41 cools the air passing through the air passage through coldness given from the Peltier element 45.

The radiator 42 is arranged at the front side of the cooler 41 and is thermally connected to the high-temperature part of the Peltier element 45. The radiator 42 is formed of a material with excellent heat conductivity and includes a plurality of fins, although not explicitly illustrated in the drawing, and spaces between the fins form an air passage for passing air. The radiator 42 heats the air passing through the air passage through high-temperature waste heat given from the Peltier element 45 to radiate heat.

The circulating fan 43 is arranged at the rear side of the cooler 41 within a wind tunnel 46 with a heat insulating structure formed so that the air inlet 241 and an air outlet 242 formed at the rear side of the heat insulating bottom plate 24 communicate with each other. The circulating fan 43 is driven to draw air within the storage room 11 through the air inlet 241 and cause the drawn air to pass through the air passage of the cooler 41.

The circulating fan 43 blows the air having passed through the air passage of the cooler 41 to the storage room 11 through the air outlet 242, thereby circulating the air within the storage room 11 between the storage room 11 and the machine room 12.

The radiator fan 44 is arranged at the front side of the radiator 42. The radiator fan 44 is driven to draw outside air through an air inlet 251 formed in a bottom plate 25 of the machine room 12 and cause the outside air to pass through the air passage of the radiator 42. The radiator fan 44 discharges the outside air having passed through the air passage of the radiator 42 to the outside through a discharge port 252 formed in the bottom plate 25 of the machine room 12.

The bottom plate 25 of the machine room 12, that is, the bottom plate 25 of the case main body 10 is provided with a drain water discharge port 253 in addition to the air inlet 251 and the discharge port 252, and a drain pan 51 and a guide member 55 are arranged thereon.

The drain water discharge port 253 is an opening that is formed at the rear side of the discharge port 252 and discharges drain water generated inside (the cooler 41, for example) the case main body 10 and having moved through a gutter 52 to the outside.

The drain pan 51 is arranged below the drain water discharge port 253 and stores therein the drain water discharged through the drain water discharge port 253. A flange 53 formed at the upper part of the drain pan 51 is supported by a pair of right and left drain supports 54 formed so as to protrude downward than the bottom plate 25 of the machine room 12.

The guide member 55 is formed by bending a plate-shaped member and is arranged so as to protrude downward than the bottom plate 25 of the machine room 12 in between the air inlet 251 and the discharge port 252. The guide member 55 includes a guide base 551, a guide downward-extending part 552, and a guide rearward-extending part 553.

The guide base 551 is a part attached to the bottom plate 25 of the machine room 12. The guide downward-extending part 552 is a part that extends downward from the rear end edge of the guide base 551. The guide rearward-extending part 553 is a part that extends rearward from the lower end or the extension end of the guide downward-extending part 552.

The guide member 55 is formed so as to have a length in the right-and-left direction larger than those of the air inlet 251 and the discharge port 252 and prevents the air blown out of the discharge port 252 from passing toward the air inlet 251 at the front side while guiding the air to pass near the drain pan 51 at the rear side. The symbol 26 in FIG. 1 is a leg of the case main body 10.

The door 60 is for opening and closing the rear face opening 15*a* and is a plate-shaped member having a size enough to block the rear face opening 15*a*. The door 60 is formed of transparent resin material or the like having heat insulating property.

A gasket 61 is arranged at the periphery of a front face of the door 60, that is, a part, when the rear face opening 15*a* is blocked, facing a metallic frame of the case main body 10 forming the periphery of the rear face opening 15*a*. The gasket 61 is preferably a magnet gasket that can adhere to the periphery of the rear face opening 15*a* through magnetic force when the door 60 blocks the rear face opening 15*a*.

A rear face duct 62 is arranged on the front face of the door 60. The rear face duct 62 forms an air passage extending in the up-and-down direction with the front face of the door 60 and includes an inlet 621 and injection holes 622.

The inlet 621 is an opening formed at a lower position and is an opening for introducing air when the circulating fan 43 is driven as described below. The air introduced through the inlet 621 passes through the air passage. The inlet 621 is positioned above the air outlet 242 when the door 60 blocks the rear face opening 15*a*.

Many injection holes 622 formed on a front face of the rear face duct 62 are holes for injecting the air passing through the air passage frontward when the circulating fan 43 is driven. The rear face duct 62 is formed of a transparent resin material or the like together with the door 60.

The door 60 is arranged in a swingable manner about a central axis of a shaft 63 (refer to FIG. 18) arranged at the left edge (the metallic frame) of the rear face opening 15*a* constituting the rear face 15 of the case main body 10 and swings about the central axis of the shaft 63, thereby opening and closing the rear face opening 15*a*.

Figure 18:
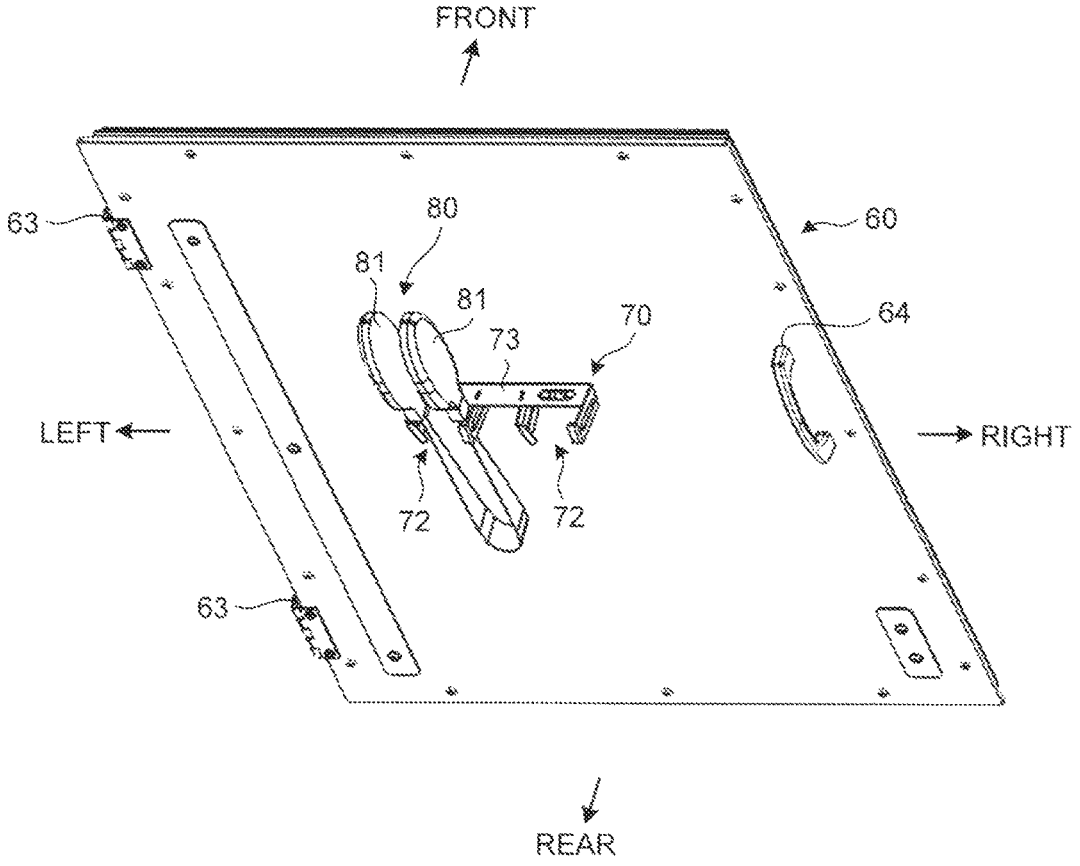
FIG. 18 is a perspective view illustrating a rear face side of a door illustrated in FIG. 1.

FIG. 18 is a perspective view illustrating the rear face side of the door 60 illustrated in FIG. 1. As illustrated in FIG. 18, a door grip 64 and a support member 70 are arranged on the rear face of the door 60. The door grip 64 is attached to the right side of the rear face of the door 60.

Figure 19:
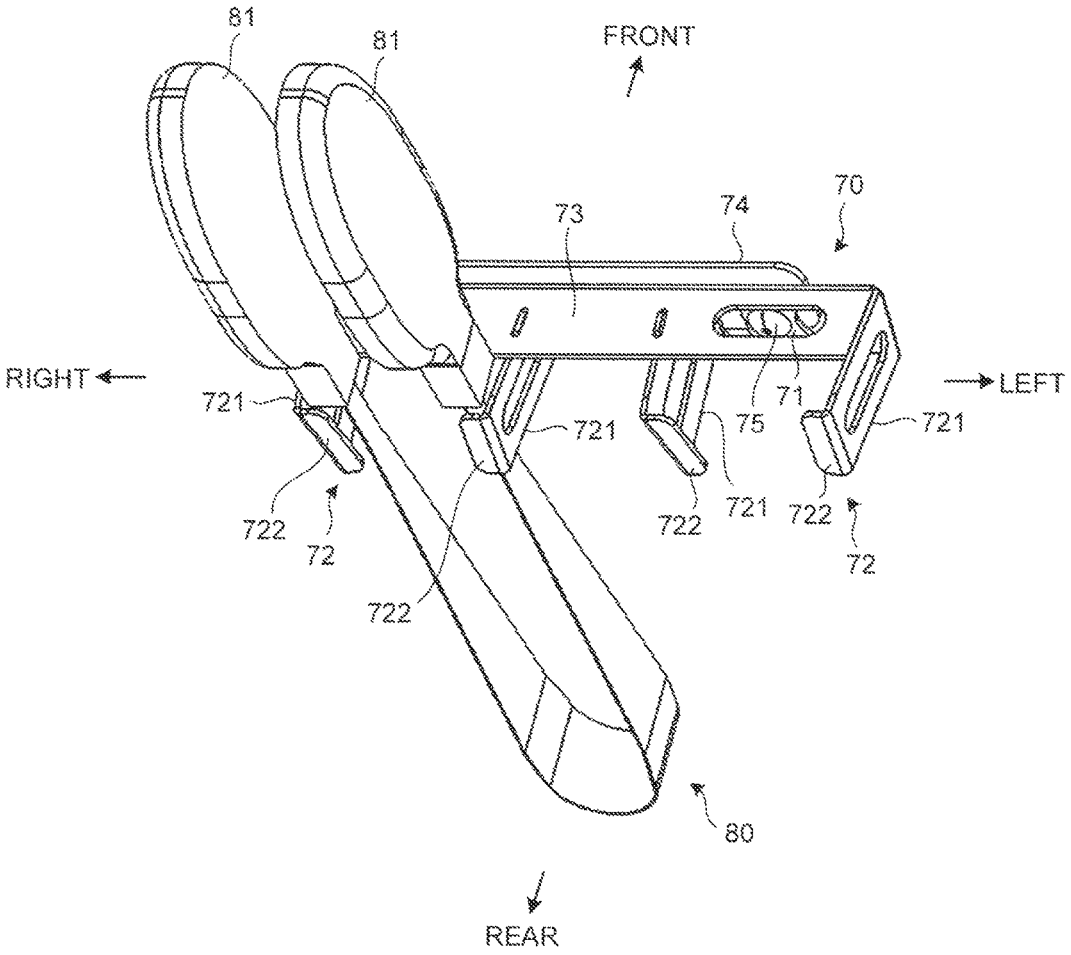
FIG. 19 is a perspective view of a support member.
Figure 20:
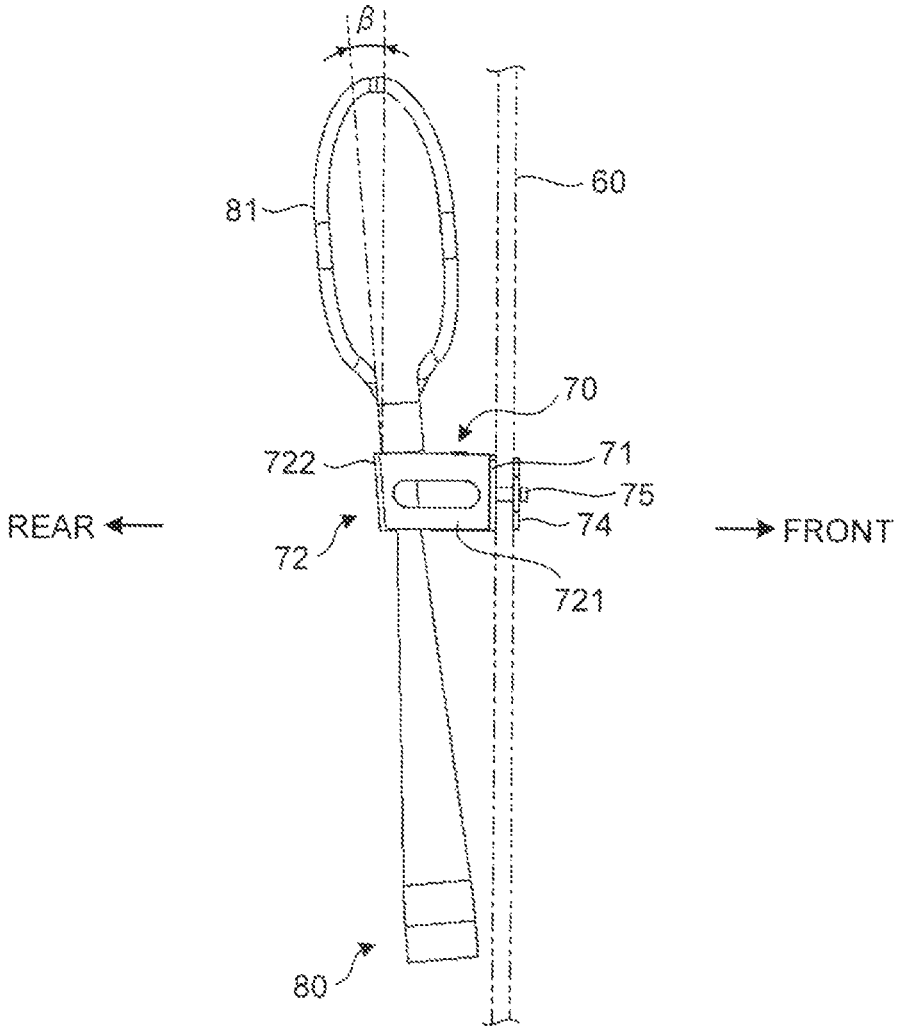
FIG. 20 is a left side view of the support member.

FIG. 19 and FIG. 20 illustrate the support member 70 illustrated in FIG. 18: FIG. 19 is a perspective view, whereas FIG. 20 is a left side view. As illustrated in FIG. 19 and FIG. 20, the support member 70 integrally includes a support base 71, support hand parts 72, and a limiting part 73 and is coated with polyethylene.

The support base 71 is fastened to the door 60 by clamping the door 60 with itself and a support plate 74 positioned on the front face side of the door 60 and being screwed to a fastening screw 75 as a faster together with the support plate 74.

A plurality of (two in the illustrated example) support hand parts 72 are arranged on the support base 71 in a right-and-left paired manner. The left support hand part 72 in FIG. 19 has the same structure as that of the right support hand part 72, and the following describes the right support hand part 72, with a description of the left support hand part 72 appropriately omitted.

The support hand part 72 includes a pair of right and left arms 721. The arms 721 are formed so as to protrude rearward from the support base 71. The pair of right and left arms 721 extend so as to be gradually close to each other downward. The rear ends of the respective arms 721 are provided with respective support pieces 722. The support pieces 722 are formed by bending the rear end of one arm 721 out of the pair of right and left arms 721 toward the other arm 721.

The support hand part 72 supports tongs 80 in between the pair of right and left arms 721. The tongs 80 are supported by the support hand part 72 so that tips 81 for gripping articles are directed upward. The support hand parts 72 are arranged on the support base 71 in a right-and-left paired manner as described above, in which a separation distance between the pair of right and left support hand parts 72 is set to a size enough to enable the tips 81 of pieces of the tongs 80 supported by the respective support hand parts 72 to be separated from each other.

The limiting part 73 is a plate-shaped part formed by bending the upper end of the support base 71 rearward. The limiting part 73 is arranged so as to be astride the pair of right and left support hand parts 72 above the pair of right and left arms 721 constituting the support hand parts 72. The limiting part 73 is in contact with the tongs 80 supported by the support hand part 72 through its rear end edge and has a length in the front-and-rear direction enough to separate the tips 81 of the tongs 80 from the rear face of the door 60. In other words, the limiting part 73 prevents the tips 81 of the tongs 80 supported by the support hand part 72 from being close to the rear face of the door 60.

As illustrated in FIG. 20, the support pieces 722 extend rearward so as to gradually separate from the door 60 upward. An inclination angle β of the support pieces 722 with respect to the vertical direction is set to 3° to 20°, for example. The support pieces 722 are thus inclined by the inclination angle β, thereby allowing the limitation of the attitude of the tongs 80 by the limiting part 73.

In the showcase having the above configuration, the circulating fan 43 is driven with the rear face opening 15*a* blocked by the door 60, thereby causing the air inside the storage room 11 to reach the cooler 41 through the air inlet 241. The air that has reached the cooler 41 passes through the air passage to be cooled, passes through the wind tunnel 46, and is blown out to the storage room 11 through the air outlet 242.

The air blown out of the air outlet 242 is introduced to the rear face duct 62 through the inlet 621, passes through the air passage, is injected frontward out of the injection holes 622, passes near the articles on the article mounting shelves 16, and is then drawn into the air inlet 241, thus repeating the above-described circulation. Consequently, the air inside the storage room 11 is cooled, thereby cooling the articles mounted on the article mounting shelves 16.

Meanwhile, the radiator fan 44 is driven, and outside air passes through the air passage of the radiator 42 through the air inlet 251 to be heated and is then discharged to the outside from the discharge port 252. The air discharged to the outside is moved rearward by the guide member 55, passes near the drain pan 51, and is discharged.

In the showcase, when work to take out the articles mounted on the article mounting shelves 16 is performed, the door 60 is operated to open and moved to open, thereby opening the rear face opening 15*a*. Subsequently, a drawing operation that draws the shelf board 19 of the article mounting shelf 16 that mounts a desired article rearward is performed, thereby causing the shelf board 19 to slidingly move rearward, and the work to take out the article is performed.

After the article is taken out, a pushing operation that pushes in the shelf board 19 operated to be drawn frontward is performed, thereby causing the shelf board 19 to slidingly move frontward. Subsequently, the door 60 is operated to close and moved to close, thereby causing the gasket 61 to adhere to the periphery of the rear face opening 15*a* on the rear face 15 of the case main body 10 and blocking the rear face opening 15*a*.

In the showcase as the present embodiment as described above, the door 60 is operated to open and moved to open, thereby opening the rear face opening 15*a*, the shelf board 19 of the desired article mounting shelf 16 is operated to be drawn, and the shelf board 19 is slidingly moved out of the case main body 10 through the rear face opening 15*a*, thereby enabling work to take out the article or the like to be performed on the shelf board 19 slidingly moved out of the case main body 10 without causing salesclerks of stores to insert their fingers inside the case main body 10 unlike conventional cases.

In addition, the bracket 17 is supported by the shelf column 20 by causing the locking pieces 172 to be inserted into the first locking holes 201 of the shelf column 20 and causing the lower edges 201*a* of the first locking holes 201 to relatively enter the notches 172*a* formed in the locking pieces 172, thereby causing the locking pieces 172 to be locked to the first locking holes 201, and what is called inward falling, in which the bracket 17 inclines inward, can be prevented, thereby enabling the shelf board 19 to be favorably moved. Consequently, work to take out articles or the like can be easily performed by smoothly moving the shelf board 19.

The bracket 17 causes the facing faces of the engaging pieces 174 to be in contact with the inner face of the shelf board 19 when the locking pieces 172 are inserted into the first locking holes 201, also thereby preventing what is called inward falling, in which the bracket 17 inclines inward, and thereby enabling the shelf board 19 to be favorably moved.

In the showcase, the side stopper 175 arranged at the front end of the bracket 17 has a size that enables the tip thereof to be in contact with the side face 14 of the case main body 10, and the bracket 17 is prevented from approaching the side face 14 when the shelf board 19 slidingly moves, thereby enabling what is called right-and-left movement, in which the bracket 17 shakes in the right-and-left direction, to be prevented. The shelf board 19 can be thereby favorably moved. Consequently, work to take out articles or the like can be easily performed by smoothly moving the shelf board 19.

In the showcase, the bracket 17 is supported by the shelf column 20 with the locking protrusion 173*a* inserted into the second locking hole 202 of the shelf column 20 and with the rear face of the contact piece 173 being in contact with the front face of the shelf column 20, thereby enabling what is called up-and-down movement, in which the bracket 17 shakes in the up-and-down direction when the shelf board 19 slidingly moves, to be prevented and thereby enabling the shelf board 19 to be favorably moved. Consequently, work to take out articles or the like can be easily performed by smoothly moving the shelf board 19.

In the showcase, the LED cover 31 constituting the illuminating member 30 has a curvature nearly equal to that of the front face 13 of the case main body 10, and the gap between the illuminating member 30 and the front face 13 can be a constant size. In addition, the LED substrate 33 stored in the LED cover 31 is only formed in a curved shape, and there is no need to bend an LED substrate or connect a plurality of LED substrates with wiring unlike conventional cases, thus improving reliability and reducing an increase in parts count. Consequently, high reliability is ensured, and appearance can be improved while reducing an increase in manufacturing costs. In particular, the LED cover 31 stores therein the LED substrate 33 so that the light emitted from each of the LEDs 34 is applied to the central part at the front end of the corresponding article mounting shelf 16, and the articles mounted on the article mounting shelves 16 can be favorably illuminated, and appearance can be improved.

In the showcase, the limiting part 73 of the support member 70 prevents the tips 81 of the tongs 80 supported by the support hand part 72 from being close to the rear face of the door 60, and the tips 81 that grip articles are prevented from being in contact with the rear face of the door 60, and sanitariness can be favorable. Consequently, the tongs 80 can be supported by the case main body 10 while maintaining sanitariness.

In the support member 70 in particular, when the support hand parts 72 are arranged on the support base 71 in a right-and-left paired manner, the separation distance between the pair of right and left support hand parts 72 is set to the size enough to enable the tips 81 of pieces of tongs 80 supported by the respective support hand parts 72 to be separated from each other, and the tips 81 of the pieces of tongs 80 are prevented from being in contact with each other, and sanitariness can be favorable.

The support member 70 is coated with polyethylene, and salesclerks of stores or the like are prevented from being injured or the like when their fingers are brought into contact therewith, for example.

Furthermore, the showcase produces the following effects.

In the showcase, the shelf handle 194 is formed so as to extend upward at the central part in the right-and-left direction at the read end of the shelf board 19, and salesclerks of stores or the like can favorably draw the shelf board 19 while gripping the shelf handle 194.

In the showcase, the shelf board 19 constituting the article mounting shelf 16 can be easily removed from the receiving members 18 by disengaging the hooks 193 from the front edge of the receiving oblong holes 184 of the receiving members 18, and cleaning of the shelf board 19 or the like can be easily performed.

In the showcase, the locking protrusions 173*a* can be disengaged from the second locking holes 202 while disengaging the locking pieces 172 from the first locking holes 201 by moving the brackets 17 inward with respect to the shelf columns 20, thereby enabling the brackets 17 to be easily removed together with the rails 21 and the receiving members 18, and cleaning of the brackets 17 or the like can be easily performed.

Although the preferred embodiment of the present invention has been described, the present invention is not limited thereto, and various alterations can be made.

Although in the embodiment the bracket 17 is supported by the shelf column 20 by causing the locking pieces 172 to be inserted into the first locking holes 201 of the shelf column 20 and causing the lower edges 201*a* of the first locking holes 201 to relatively enter the notches 172*a* formed in the locking pieces 172, thereby causing the locking pieces 172 to be locked to the first locking holes 201, the inward falling of the bracket may be prevented by inserting the locking pieces into the inner face locking holes of the shelf column and hanging a long center bar across the pair of right and left brackets.

Although in the embodiment the right-and-left movement of the bracket 17 is prevented by causing the side stopper 175 arranged at the front end of the bracket 17 to be in contact with the side face 14 of the case main body 10, the side stopper may be arranged on the side face of the case main body and cause its tip to be in contact with the bracket. Although the side stopper 175 is exemplified as an example of the limiting unit, the configuration of the limiting unit is not particularly limited so long as the limiting unit is interposed between the bracket and one side face that is close to the bracket out of a pair of right and left side faces of the case main body and the limiting unit can prevent the bracket from approaching the one side face.

Although in the embodiment the locking protrusion 173*a* is arranged at the lower end of the contact piece 173, the locking protrusion may be arranged at the upper end of the contact piece.

The shelf board constituting the article mounting shelf can slidingly move rearward when being operated to be drawn rearward in between the brackets supported by the shelf columns that are erected at the rear side of the storage area. Thus, the shelf board can be slidingly moved out of the case main body through the opening through which the shelf board has been operated to be drawn, and work to take out the article or the like can be performed on the shelf board slidingly moved out of the case main body without causing salesclerks of stores to insert their fingers inside the case main body unlike conventional cases. In addition, the bracket is supported by the shelf column by causing the locking pieces to be inserted into the inner face locking holes of the shelf column and causing the lower edges of the inner face locking holes to relatively enter the notches formed in the locking pieces, thereby causing the locking pieces to be locked to the inner face locking holes, and what is called inward falling, in which the bracket inclines inward, can be prevented, thereby enabling the shelf board to be favorably moved. Consequently, an effect of being capable of easily performing work to take out articles or the like by smoothly moving the shelf board is produced.

The shelf board constituting the article mounting shelf can slidingly move rearward when being operated to be drawn rearward in between the brackets supported by the shelf columns that are erected at the rear side of the storage area. Thus, the shelf board can be slidingly moved out of the case main body through the opening through which the shelf board has been operated to be drawn, and work to take out the article or the like can be performed on the shelf board slidingly moved out of the case main body without causing salesclerks of stores to insert their fingers inside the case main body unlike conventional cases. In addition, the limiting unit that is interposed between each of the brackets and one side face that is close to each of the brackets out of a pair of right and left side faces of the case main body prevents each of the brackets from approaching the one side face, thereby enabling what is called right-and-left movement, in which the bracket shakes in the right-and-left direction when the shelf board slidingly moves, to be prevented and enabling the shelf board to be favorably moved. Consequently, an effect of being capable of easily performing work to take out articles or the like by smoothly moving the shelf board is produced.

The shelf board constituting the article mounting shelf can slidingly move rearward when being operated to be drawn rearward in between the brackets supported by the shelf columns that are erected at the rear side of the storage area. Thus, the shelf board can be slidingly moved out of the case main body through the opening through which the shelf board has been operated to be drawn, and work to take out the article or the like can be performed on the shelf board slidingly moved out of the case main body without causing salesclerks of stores to insert their fingers inside the case main body unlike conventional cases. In addition, the bracket is supported by the shelf column with the locking protrusion inserted into the front face locking hole of the shelf column and with the rear face of the contact piece being in contact with the front face of the shelf column, thereby enabling what is called up-and-down movement, in which the bracket shakes in the up-and-down direction when the shelf board slidingly moves, to be prevented and thereby enabling the shelf board to be favorably moved. Consequently, an effect of being capable of easily performing work to take out articles or the like by smoothly moving the shelf board is produced.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A showcase comprising:

a case main body including:

a front face disposed on a front side of the case main body and constituting a customer serving face; and a rear face disposed on a rear side of the case main body and having an opening that is opened and closed by a door;

one or more article mounting shelves that are arranged in one or more stages in an up-and-down direction in a storage area provided in the case main body and on which articles to be stored are placed; and left and right shelf columns disposed at the rear side of the case main body and extending in the up-and-down direction to support the one or more article mounting shelves, the left and right shelf columns including respective inner faces which face each other, wherein the showcase is configured to display the articles placed on the article mounting shelves through the customer serving face, each of the article mounting shelves includes:

left and right brackets supported by the left and right shelf columns, respectively; and a shelf board being disposed between the left and right brackets, including an upper face which constitutes an article mounting face on which the articles are placed and being configured to slidably move rearward when the shelf board is operated to be drawn rearward, each of the left and right brackets includes a rear end part on the rear side of the each of the left and right brackets and respective bent parts at the rear end part, the bent parts constituting respective locking pieces, the bent parts of the left and right brackets being bent in directions opposite to the directions where the right and left brackets are disposed, respectively, and the bent parts include respective notches at lower ends of predetermined areas of the bent parts, the left and right brackets are supported by the left and right shelf columns, respectively, in a state where the locking pieces are inserted into corresponding inner face locking holes which are provided on the inner face of the left and right shelf columns and the notches are in contact with respective lower edges of the inner face locking holes, so as to lock the locking pieces to the inner faces of the left and right shelf columns, the left and right brackets include respective engaging pieces, each of the engaging pieces extending rearward in a longitudinal direction being a same direction as a longitudinal direction of the left and right brackets, the engaging pieces have respective faces which face and are in contact with the inner faces of the left and right shelf columns, respectively, so that entire surfaces of the faces of the engaging pieces of the left and right brackets are in contact with the inner faces of the left and right shelf columns, respectively, in a state where the locking pieces are inserted into the respective inner face locking holes, the left and right brackets further include respective another bent parts, which constitute contact pieces each being formed by cutting and raising a rectangular part surrounded by the corresponding left or right bracket and located in front of the locking piece of the corresponding left or right bracket, the another bent parts of the left and right brackets being bent in the directions opposite to the directions where the right and left brackets are disposed, respectively, and each of the another bent parts includes a locking protrusion protruding rearward on at least one of an upper end or a lower end of the another bent parts, the left and right brackets are supported by the left and right shelf columns, respectively, in a state where the locking protrusions are inserted into front face locking holes provided on front faces of the left and right shelf columns and rear faces of the contact pieces are in contact with the front faces of the left and right shelf columns, and the left and right brackets are supported by the left and right shelf columns in a state where the contact pieces of the left and right brackets are in surface contact with the front faces of the left and right shelf columns, respectively.

2. The showcase according to claim 1, wherein the contact pieces are elongated parts extending in the up-and-down direction as a longitudinal direction of the contact pieces.

3. The showcase according to claim 1, wherein the contact pieces of the left and right brackets are in surface contact with the front faces of the left and right shelf columns, the locking pieces of the left and right brackets are inserted into the corresponding inner face locking holes on the inner faces of the left and right shelf columns, and the engaging pieces of the left and right brackets are in surface contact with the inner faces of the left and right shelf columns so that the left and right brackets are supported on the respective left and right columns.

4. The showcase according to claim 3, wherein each of the left and right brackets further comprises:

a limiting unit disposed at a front end part of the corresponding left or right bracket, the limiting unit protruding from an outer face toward the case main body to prevent the corresponding left or right bracket from approaching the case main body when the shelf board is operated to be drawn rearward, and a bracket roller disposed on an inner face opposite to the outer face of the corresponding left or right bracket to allow the shelf board to slidably move rearward, and when the shelf board is operated to be drawn rearward, the shelf board slidably moves rearward through the bracket rollers, and the limiting units prevent the left and right brackets from approaching the case main body while the shelf board is moving rearward.

5. The showcase according to claim 4, wherein each of the article mounting shelves further comprises:

left and right receiving members slidably connected to the respective left and right brackets to support the shelf board, and each of the left and right receiving members having a receiving unit roller to slidably move rearward with the shelf board, and left and right rails slidably connecting the left and right receiving members to the respective left and right brackets, and each of the left and right rails has a first side and a second side opposite to the first side, and the receiving unit rollers are fitted in the corresponding first sides of the left and right rails, and the bracket rollers are fitted in the corresponding second sides of the left and right rails so that the left and right rails slidably move rearward in respect to the left and right brackets, and the left and right receiving members slidably move rearward in respect to the left and right rails.

6. The showcase according to claim 5, wherein each of the left and right receiving members further comprises a receiving upper face for supporting the shelf board, the receiving upper face including a receiving hole elongated in a moving direction of the left and right receiving members, and a reception stopper arranged on the receiving upper face to limit a rearward movement of the shelf board in respect to the left or right receiving member; and the shelf board includes left and right engaging members on a lower face of the shelf board to detachably attach to the left and right receiving members respectively, each of the left and right engaging members including an elongated protrusion protruding downwardly to enter the receiving hole, and a hook arranged at an end portion of the elongated protrusion to engage an edge of the receiving hole so that the shelf board is engaged to the left and right receiving members with the hooks of the left and right engaging members and the reception stoppers of the left and right receiving members.

7. The showcase according to claim 1, wherein the inner face locking hole of the left shelf column includes a plurality of inner face locking holes spaced apart from each other in the up-and-down direction, the locking piece of the left bracket includes a plurality of locking pieces spaced apart from each other and inserted into the plurality of inner face locking holes of the left shelf column, respectively, the plurality of locking pieces of the left bracket extending perpendicularly to the longitudinal direction of the left bracket and in parallel with the contact piece of the left bracket, the plurality of locking pieces of the left bracket and the contact piece of the left bracket are spaced apart from each other in the longitudinal direction of the left bracket to sandwich the left shelf column and secure the left bracket to the left shelf column, the inner face locking hole of the right shelf column includes a plurality of inner face locking holes spaced apart from each other in the up-and-down direction, the locking piece of the right bracket includes a plurality of locking pieces spaced apart from each other and inserted into the plurality of inner face locking holes of the right shelf column, respectively, the plurality of locking pieces of the right bracket extending perpendicularly to the longitudinal direction of the right bracket and in parallel with the contact piece of the right bracket, and the plurality of locking pieces of the right bracket and the contact piece of the right bracket are spaced apart from each other in the longitudinal direction of the right bracket to sandwich the right shelf column and secure the right bracket to the right shelf column.

8. The showcase according to claim 7, wherein in the state where the plurality of locking pieces of the left and right brackets are inserted into the corresponding plurality of inner face locking holes of the left and right shelf columns, the engaging pieces contact the corresponding inner faces of the left and right shelf columns, the contact pieces contact the corresponding front faces of the left and right shelf columns, and the locking protrusions are inserted into the corresponding front face locking holes of the left and right shelf columns.

9. The showcase according to claim 8, wherein each of the contact pieces is formed between upper and lower edges of the corresponding left or right bracket in the up-and-down direction and has one side connected to the corresponding left or right bracket and the other sides being separate from the corresponding left or right bracket.

10. The showcase according to claim 9, wherein the lower ends of the contact pieces are bent along a direction perpendicular to the up-and-down direction so that the locking protrusions protrude rearward.

11. A showcase for displaying articles through a customer serving face, comprising:

a case main body including a front face disposed on a front side of the case main body and constituting the customer serving face, and a rear face disposed on a rear side of the case main body;

a pair of shelf columns disposed at the rear side of the case main body and extending in an up-and-down direction of the case main body, each shelf column of the pair of shelf columns including a plurality of side face locking holes arranged on a side face of the shelf column and spaced apart from each other in the up-and-down direction, and a plurality of front face locking holes arranged on a front face of the shelf column and spaced apart from each other in the up-and-down direction, the front face being different from the side face; and an article mounting shelf arranged inside the case main body, and including a shelf board for placing the articles and configured to slidably move rearward in a moving direction, and a pair of brackets supported by the pair of shelf columns, respectively, extending along the moving direction of the shelf board and sandwiching the shelf board therebetween, each bracket of the pair of brackets having a rear end part including a plurality of locking pieces spaced apart from each other in the up-and-down direction and bent in a direction perpendicular to the moving direction to engage the plurality of side face locking holes, each of the plurality of locking pieces being locked to the side face of the shelf column through a notch at a lower end of each of the plurality of locking pieces, an engaging piece extending perpendicular to the plurality of locking pieces and disposed rearward of the plurality of locking pieces to surface contact the side face of the shelf column, and a contact piece disposed in front of the plurality of locking pieces and formed by cutting and raising a rectangular part from the bracket wherein the rectangular part is surrounded by the corresponding bracket and bent toward a direction same as the direction along which the plurality of locking pieces is bent, the contact piece including a locking protrusion protruding rearward from a lower end of the contact piece, wherein in each bracket, the contact piece is parallel to the plurality of locking pieces and spaced apart from the plurality of locking pieces to sandwich the corresponding shelf column, and in a state in which the plurality of locking pieces of the pair of brackets are inserted into the plurality of side face locking holes of the pair of shelf columns, the engaging pieces surface contact the side faces of the pair of shelf columns, the contact pieces surface contact the front faces of the pair of shelf columns, and the locking protrusions are inserted into the front face locking holes of the pair of shelf columns.

* * * * *